US011192669B2

(12) United States Patent
Viale et al.

(10) Patent No.: US 11,192,669 B2
(45) Date of Patent: Dec. 7, 2021

(54) SYSTEMS FOR RECOGNIZING CONTAINERS TO BE FILLED WITH AND/OR EMPTIED OF GIVEN TYPES OF PRODUCTS

(71) Applicant: Guala Closures S.p.A., Alessandria (IT)

(72) Inventors: Luca Viale, Alessandria (IT); Marco Giovannini, Luxembourg (LU)

(73) Assignee: GUALA CLOSURES S.P.A., Alessandria (IT)

( * ) Notice: Subject to any disclaimer, the term of this patent is extended or adjusted under 35 U.S.C. 154(b) by 37 days.

(21) Appl. No.: 16/760,358

(22) PCT Filed: Oct. 24, 2018

(86) PCT No.: PCT/IB2018/058301
§ 371 (c)(1),
(2) Date: Apr. 29, 2020

(87) PCT Pub. No.: WO2019/087015
PCT Pub. Date: May 9, 2019

(65) Prior Publication Data

US 2020/0339288 A1 Oct. 29, 2020

(30) Foreign Application Priority Data

Oct. 31, 2017 (IT) ..... 102017000124236

(51) Int. Cl.
*B65D 51/24* (2006.01)
*B65B 3/26* (2006.01)
(Continued)

(52) U.S. Cl.
CPC ..... *B65B 3/26* (2013.01); *B65B 69/0008* (2013.01); *B65B 3/04* (2013.01); *B65B 2210/04* (2013.01);
(Continued)

(58) Field of Classification Search
CPC ..... B65B 3/26; B65B 69/0008; B65B 3/04; B65B 2210/04; B65B 57/00; B65B 69/00; B65D 51/245; B65D 2543/00537
See application file for complete search history.

(56) References Cited

U.S. PATENT DOCUMENTS 7,705,734 B2 4/2010 Martinelli
2006/0092013 A1 5/2006 Hager et al.
(Continued)

FOREIGN PATENT DOCUMENTS

KR 10-2004-0083038 A 9/2004

OTHER PUBLICATIONS

International Search Report and Written Opinion of the International Searching Authority, dated Jan. 25, 2019, in corresponding International Application No. PCT/IB2018/058301, 6 pages.

*Primary Examiner* — Jason K Niesz
(74) *Attorney, Agent, or Firm* — MH2 Technology Law Group LLP

(57) ABSTRACT

The present invention relates to a recognition system for recognizing containers to be filled with a given type of product, wherein the containers are equipped with a device for closing and opening the mouth through which the product to be introduced into the container is designed to pass. The closing and opening device is equipped with NFC electronic identification means. A corresponding reading and writing device for reading and writing said NFC electronic identification means is provided in the station for filling of the container and, in view of accommodating the container and the device for closing and opening its mouth, such station is conformed with at least the area configured to receive the device for closing and opening the mouth having a three-dimensional shape that mates the three-dimensional shape that the closing and opening device assumes when it
(Continued)

is open to allow the container to be filled and/or emptied through the mouth.

10 Claims, 2 Drawing Sheets

(51) Int. Cl.
*B65B 69/00* (2006.01)
*B65B 3/04* (2006.01)

(52) U.S. Cl.
CPC .. *B65D 51/245* (2013.01); *B65D 2543/00537* (2013.01)

(56) References Cited

U.S. PATENT DOCUMENTS

| | | | | |
|---|---|---|---|---|
| 2010/0141756 | A1 | 6/2010 | Grote et al. | |
| 2012/0032364 | A1 | 2/2012 | Piana | |
| 2016/0159509 | A1* | 6/2016 | Lewis | B67D 7/344<br>700/243 |
| 2017/0361999 | A1* | 12/2017 | Lambrecht | B65D 51/245 |

* cited by examiner

SYSTEMS FOR RECOGNIZING CONTAINERS TO BE FILLED WITH AND/OR EMPTIED OF GIVEN TYPES OF PRODUCTS

CROSS-REFERENCE TO RELATED APPLICATION(S)

This application is a national stage entry from International Application No. PCT/IB2018/058301, filed on Oct. 24, 2018, in the Receiving Office ("RO/IB") of the International Bureau of the World Intellectual Property Organization ("WIPO"), and published as International Publication No. WO 2019/087015 A1 on May 9, 2019; International Application No. PCT/IB2018/058301 claims priority from Italian Patent Application No. 102017000124236, filed on Oct. 31, 2017, in the Italian Patent and Trademark Office ("IPTO"), the entire contents of all of which are incorporated herein by reference.

FIELD OF THE INVENTION

The present invention relates to a recognition system for the recognizing containers to be filled with and emptied of a given type of product.

DISCUSSION OF THE RELATED ART

Containers are known, which have a device for closing and opening the mouth through which the product to be introduced or removed from the container has to pass.

Preferably, but without limitation, the device for closing the mouth of the container comprises a side-lifting hinged cover for containers whose mouth is located at the end of a tubular tract having a circular section, which extends from the body of the container itself.

Particularly, the body of the container may have the shape of a bottle having a circular or quadrilateral cross section, without excluding that the body of the container may also have any other three-dimensional geometric shape, including that of a bag made of flexible material.

Closures with side-lifting hinged covers are known, also known as Flip-Top closures. They are particularly used also on containers for chemicals or pharmaceuticals, where they have the critical role of ensuring that the product that has been introduced in the container and is removed therefrom for use will certainly correspond to what has been declared.

For this purpose, it is known that, during filling, the container that is intended to contain a given product is recognized by the station at which the container has to stop to receive the given product for which it is intended and that the station provide to dispense.

Likewise, when the product is to be used, the utilization station provides to recognize the container as the one that contains the product to be utilized in the station itself.

In prior art technologies, the recognition of the container and therefore of the product contained or to be introduced therein, is performed by coded mechanical means, e.g. male-and-female means, or using electronic means with NFC technology, which, given that are placed on the container and proximate to the filling station or the utilization station, ensure by their coupling that the container is actually intended for the product to be dispensed or utilized in the station itself, depending on whether it is a filling station or a utilization station.

PRIOR ART PROBLEM

While coded-coupling mechanical or electronic means usefully assist recognition of the container in order to go back to the product contained or to be introduced therein, they are still prone to jamming, thereby generating incorrect results from which harmful consequences may result.

SUMMARY OF THE INVENTION

The object of the present invention is to provide a system secure recognition of the container and therefore of the product contained or to be introduced therein.

This object is achieved by means of a recognition system for recognizing containers to be filled with and/or emptied of a given type of product which is characterized as defined in claim 1 below.

Advantages of the Invention

The recognition system of the present invention may be also used when the device for closing and opening the mouth of the container is in turn equipped with mechanical or electronic identification means, the latter being particularly of the type that uses the Near Field Communication (NFC) technology.

Advantageously, the recognition system also applies to identification of the container and the product contained therein, during the emptying for utilization of the product. The recognition system of the present invention will provide the result of securely combining a given product with a specific container.

BRIEF DETAILS OF THE DRAWINGS

The invention will be now described in greater detail with reference to a preferred embodiment thereof, given by way of illustration and without limitation, and shown in the annexed drawings, in which.

DETAILED DESCRIPTION

Figure 1:
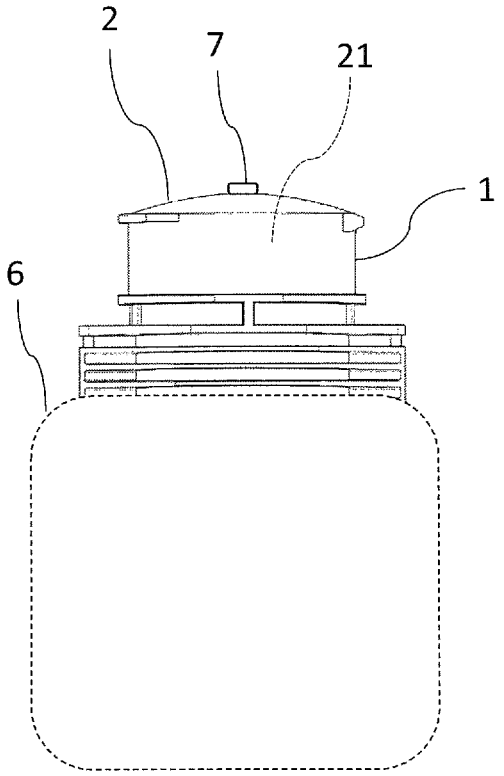
FIG. 1 shows a side view of a container equipped with a Flip-Top mouth-closing device having NFC electronic identification means, in the closed configuration.

Referring to the above figures, numeral 1 designates the tubular body, with circular cross-section, of a device for closing and opening containers, such as a Flip-Top closure for liquid containers.

The transverse cover wall 2 is connected, via a flexible hinge tab 3, at the edge 4 of the mouth 5. It acts as a cover for the latter.

The tubular body 1 of the closing and opening device is connected and applied to the mouth of a container 6.

Figure 2:
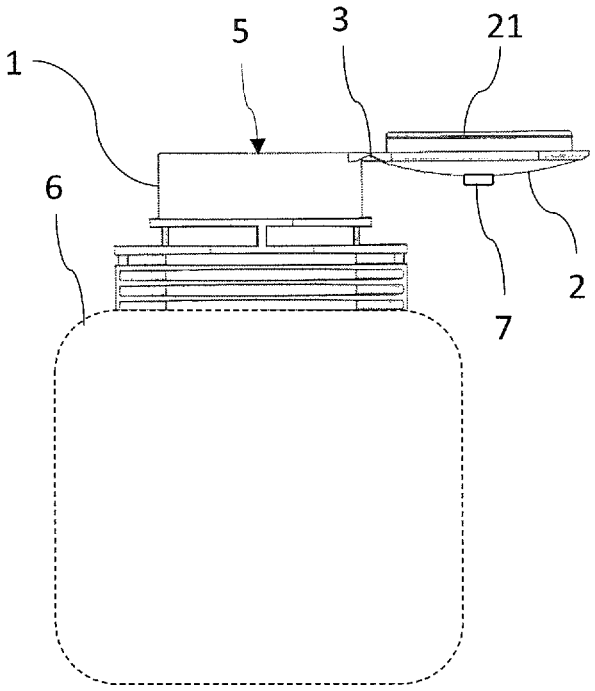
FIG. 2 shows a side view of a container like that of FIG. 1, with the cover of the Flip-Top closure device, having NFC electronic identification means, in the open configuration, with 180 degree tilt.
Figure 3:
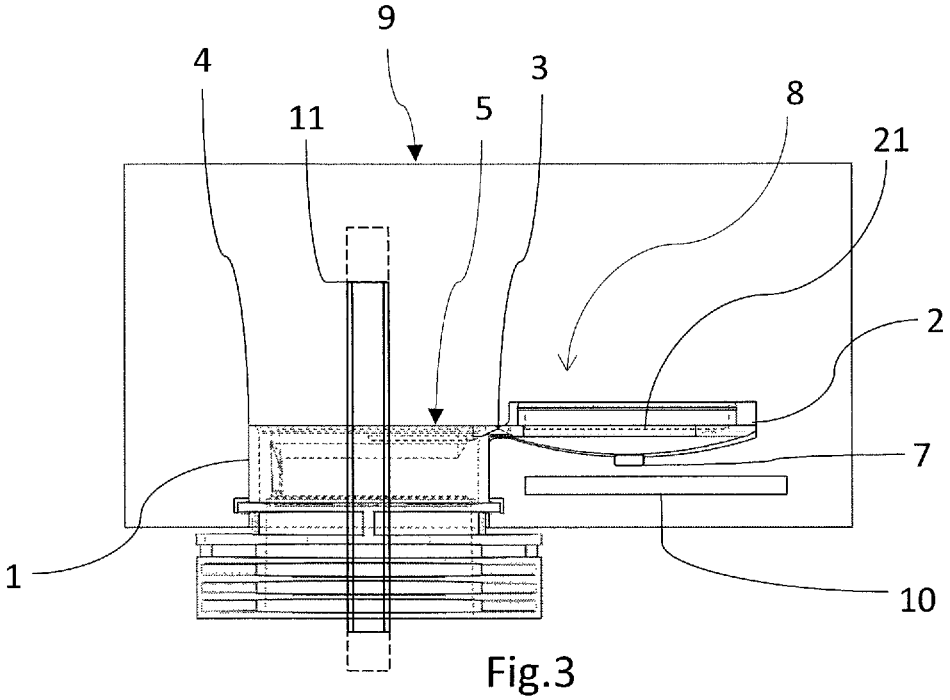
FIG. 3 shows a front view of the positioning area of the container and its closure device in the open configuration, in a filling or emptying apparatus, which is susceptible to implement the recognition system of the container according to the invention.
Figure 4:
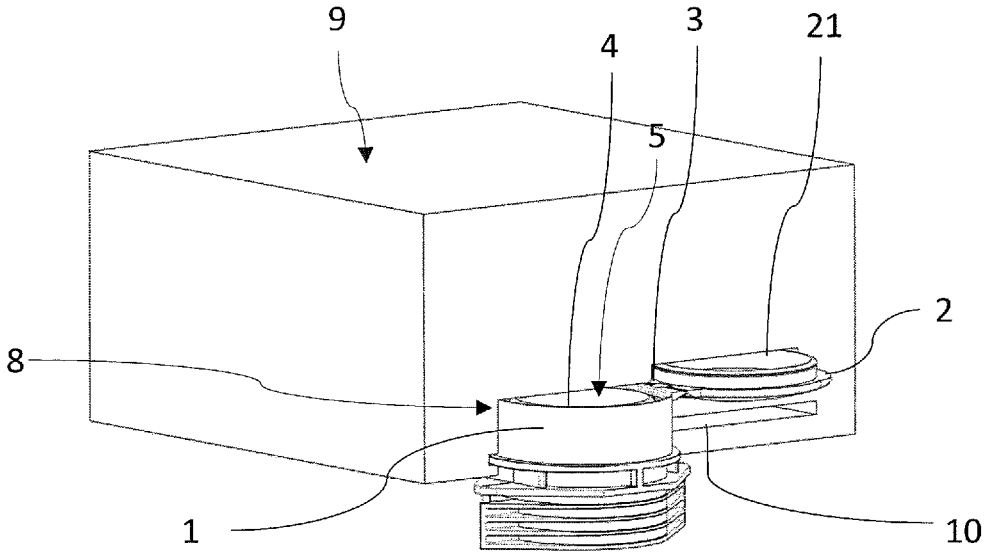
FIG. 4 shows a perspective view of the system of FIG. 3.
Figure 5:
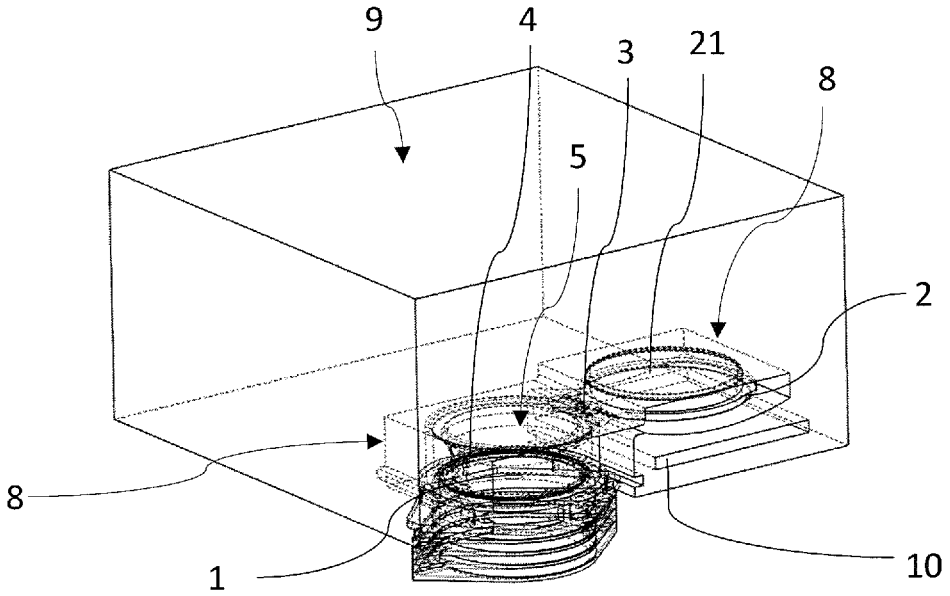
FIG. 5 shows the system of FIG. 4 in detail, with a see-through view of the container positioning area with a closing and opening device in the open configuration received therein.

By angular displacement around the edge 4, the cover wall 2 may also reach, for example, the 180° flipped open configuration as shown both in FIG. 2 and in FIGS. 3 to 5.

In other words, the cover can be angularly displaced relative to the closed configuration of the mouth 5 of the container assuming positions that allow access to the mouth 5 itself to the means for filling and/or the emptying the container 6 up to a 180° flipped position.

Alternatively, the cover wall 2 may assume an angled position relative to the edge 4 of the mouth 5 and be still deemed to be in an open configuration of the mouth 5, as long as the latter can be accessed by the means 11 for filling and/or emptying the container 6.

As shown in FIG. 1, the cover wall 2 can be lifted relative to the body 1, e.g. by a manual action on a tongue 7 that projects axially outwards of the closing and opening device.

Preferably, NFC electronic identification means 21 may be associated with such tongue 7.

According to the invention, as shown in FIG. 2, the cover 2 and the tubular body 1, when considered in the open configuration for the mouth 5, form a unique three-dimensional shape with the container 6, due to the specific size and shape of both the container and the closing and opening device assembly.

Referring to FIGS. 3 to 5, numeral 8 schematically designates the station in which the container 6 is placed, with the mouth 5 open and hence with the cover wall 2 flipped, in an apparatus 9 for filling or emptying it.

According to the invention, the three-dimensional shape of the station 8 is a conjugated or negative reproduction of the three-dimensional shape of the container 6 and the associated closing and opening device.

With such three-dimensional shape, only the specific container 6 with its closing and opening device, in the open configuration, can be uniquely accommodated and positioned in its filling and/or emptying station, achieving the result of a certainty about the type of product introduced into or removed from the container 6.

In order to increase such certainty about the product introduced into or extracted from the container 6, the station 8 comprises a reading and writing device 10 for detecting the NFC electronic identification means 21 associated with the cover wall 2.

Preferably, the reading and writing device 10 can change the value of an information data unit stored in the NFC electronic identification means 21 according to a variety of parameters, such as successful reading of the NFC electronic identification means 21 or receiving an external control signal, e.g. following completion of a step in which the product is introduced into or removed from the container 6. By this arrangement, for example, the value of the information data unit stored in the NFC electronic identification means 21 can be tracked and decreased as a result of partial removal of the product or increases as a result of partial filling.

Preferably, the cover wall 2 comes proximate to contact or in direct contact with the reading and writing device 10 when the closing and opening device is in the open configuration, to allow reading of the NFC electronic identification means 21 by the reading and writing device 10. More preferably, according to the preferred embodiment as shown in the accompanying FIGS. 1 to 5, the outer face of the cover wall 2 is convex and, due to the shape coupling with the station 8, the convex face contacts or comes proximate to contact with the reading and writing device 10 when the closing and opening device is received in the station 8 in the open configuration, i.e., when the cover wall 2 is flipped relative to the tubular body 1.

Although not expressly shown, it is evident that the structure of the closing and opening device, and particularly of its cover wall 2 and the means with which the cover wall 2 itself is connected to the body 1 of the closing and opening device, are subject to a number of construction variants, as long as the purposes of the closure are fulfilled.

The invention claimed is:

1. A container recognition system for recognizing containers to be filled with and/or emptied of a given type of product using a filling and/or emptying station, wherein the containers are equipped with a device for closing and opening a mouth through which the product to be introduced and/or removed into and from the container is designed to pass, wherein the station has a section configured for receiving the device for closing and opening the mouth of the container, the section having a three-dimensional shape that mates a three-dimensional shape that the device for closing and opening the container assumes in an open configuration for introduction or removal of the product through the mouth, wherein the device for closing and opening the container is equipped with Near-Field Communication (NFC) electronic identification means, and wherein the station comprises a reading and writing device for detecting the NFC electronic identification means associated with the closing and opening device.

2. The recognition system of claim 1, wherein the reading and writing device is configured to change a value of an information data unit that is stored in the NFC electronic identification means in response to preset events.

3. The recognition system of claim 1, wherein the closing and opening device is of the flip-top type.

4. The recognition system of claim 3, wherein the closing and opening device comprises a cover wall for closing the mouth, the cover wall being adapted to be flipped into the open configuration of the closing and opening device, and the station having a three-dimensional shape that mates the three-dimensional shape that the container and its closing and opening device assume in the open configuration with the cover wall flipped up.

5. The recognition system of claim 1, wherein the station has a three-dimensional shape mating the three-dimensional shape that the container and its closing and opening device assume in the open configuration for introduction or removal of the product through the mouth.

6. The recognition system of claim 5, wherein the closing and opening device comprises a cover wall for closing the mouth, the cover wall being adapted to be flipped into the open configuration of the closing and opening device, and the station having a three-dimensional shape that mates the three-dimensional shape that the container and its closing and opening device assume in the open configuration with the cover wall flipped up.

7. The recognition system of claim 6, wherein the cover wall is adapted to be flipped into the open configuration of the closing and opening device by an angular displacement around an edge of the mouth.

8. The recognition system of claim 6, wherein the cover wall is adapted to be flipped into the open configuration of the closing and opening device by assuming an angled position relative to an edge of the mouth.

9. The recognition system of claim 6, wherein the three-dimensional shape of the station is a negative reproduction of the three-dimensional shape of the container and its closing and opening device in the open configuration.

10. The recognition system of claim 6, wherein the NFC electronic identification means is associated with the cover wall.

* * * * *